US010935317B2

(12) United States Patent
Minnite

(10) Patent No.: US 10,935,317 B2
(45) Date of Patent: Mar. 2, 2021

(54) LAUNDRY AID DEVICE AND METHOD

(71) Applicant: Lance Minnite, Fresno, CA (US)

(72) Inventor: Lance Minnite, Fresno, CA (US)

( * ) Notice: Subject to any disclaimer, the term of this patent is extended or adjusted under 35 U.S.C. 154(b) by 0 days.

(21) Appl. No.: 15/965,490

(22) Filed: Apr. 27, 2018

(65) Prior Publication Data

US 2019/0072329 A1 Mar. 7, 2019

Related U.S. Application Data

(60) Provisional application No. 62/555,633, filed on Sep. 7, 2017.

(51) Int. Cl.

| | |
|---|---|
| ***F26B 25/00*** | (2006.01) |
| ***D06F 59/08*** | (2006.01) |
| ***D06F 95/00*** | (2006.01) |
| ***D06F 39/02*** | (2006.01) |
| *D06F 58/20* | (2006.01) |

(52) U.S. Cl.

CPC ..... *F26B 25/004* (2013.01); *D06F 39/024* (2013.01); *D06F 59/08* (2013.01); *D06F 95/008* (2013.01); *D06F 58/203* (2013.01)

(58) Field of Classification Search

CPC ..... F26B 25/004; D06F 59/08; D06F 58/203; D06F 39/024

USPC ..... 34/380, 236

See application file for complete search history.

(56) References Cited

U.S. PATENT DOCUMENTS

| | | | | |
|---|---|---|---|---|
| 5,279,048 | A * | 1/1994 | Lawall | A45D 20/12 34/90 |
| 6,742,683 | B1 * | 6/2004 | Phan | D06F 95/006 223/84 |
| 8,205,351 | B2 * | 6/2012 | Howe | B67D 7/00 222/1 |
| 8,608,600 | B2 | 12/2013 | Naum | |
| 9,228,289 | B2 * | 1/2016 | Oh | D06F 39/024 |
| D832,539 | S * | 10/2018 | Baird | D32/29.1 |
| 10,494,749 | B1 * | 12/2019 | Baughman | D06F 39/00 |
| 2001/0031677 | A1 | 10/2001 | Coleman et al. | |
| 2009/0205218 | A1 | 8/2009 | Howe et al. | |
| 2010/0205787 | A1 | 8/2010 | Remmert | |
| 2013/0127263 | A1 * | 5/2013 | Park | B08B 3/04 310/10 |
| 2015/0026994 | A1 * | 1/2015 | Holder | D06F 58/20 34/236 |

* cited by examiner

*Primary Examiner* — John P McCormack
(74) *Attorney, Agent, or Firm* — Runyan Law; Charles Runyan

(57) ABSTRACT

A laundry aid device including a spherical-body and a plurality of spokes. The laundry aid device is preferably constructed from heat resistant rubber materials for flexibility and constructed from anti-bacterial and anti-fungal materials. The spokes extend radially from the spherical-body, each of the spokes including a head affixed to an end of the spoke furthest from the spherical-body, and a neck disposed between the spherical-body and the head of the spoke. The spokes each also include circumferential ribs located between the neck and the head of the spoke. The circumferential ribs are constructed of a flexible material such that the head of the spoke is able to flex in relation to the remainder of the spoke. The device is placeable into a laundry machine to prevent tangling of clothing and linens and increase the efficiency of the laundering of the laundry machine.

19 Claims, 5 Drawing Sheets

LAUNDRY AID DEVICE AND METHOD

CROSS-REFERENCE TO RELATED APPLICATION(S)

The present application is related to and claims priority to U.S. Provisional Patent Application No. 62/555,633 filed Sep. 7, 2017, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

TECHNICAL FIELD

The present invention relates generally to the field of textiles of existing art and more specifically relates to textile laundering.

RELATED ART

Laundry is the washing of clothing and linens. A washing machine (laundry machine, clothes washer, or washer) is a machine used to wash laundry. Additionally, some people prefer to use a drying machine to quickly dry the laundry after washing. Residential and commercial washers and dryers often require laundry to be placed within the same compartment or drum. During the process, the laundry may be moved around and become entangled. Entanglement may inhibit the effectiveness in washing and drying the laundry. Therefore, a suitable solution is desired.

U.S. Pub. No. 2015/0026994 to Jack M. Holder relates to an apparatus for preventing entanglement of sheets in a dryer. The described apparatus for use with a dryer serves to prevent an entanglement of the sheets disposed therein, and to reduce energy consumed and a time required to dry the sheets. The apparatus includes a center hub with a plurality of tubular prongs oriented such that each tubular prong is equidistant from each adjacent tubular prong, and a plurality of tubular members with first ends affixed to the plurality of tubular prongs. Second ends of the plurality of tubular members are configured to sufficiently contact the sheets to create a separation between the sheets to enhance air flow around the sheets when the dryer is operating.

SUMMARY OF THE INVENTION

In view of the foregoing disadvantages inherent in the known textile laundering art, the present disclosure provides a novel laundry aid device and method. The general purpose of the present disclosure, which will be described subsequently in greater detail, is to provide an efficient and effective laundry aid device and method.

A laundry aid device is disclosed herein. The laundry aid device includes a spherical-body, and a plurality of spokes. The laundry aid device is preferably constructed from heat resistant rubber materials for flexibility. Further, the laundry aid device is preferably constructed from anti-bacterial and anti-fungal materials.

The spokes extend radially from the spherical-body, with each of the spokes including a head affixed to the end of the spoke furthest from the spherical-body, and a neck disposed between the spherical-body and the head of the spoke. The head of each of the spokes preferably includes a flat surface, with the flat surface arranged substantially parallel to the surface of the spherical-body.

The spokes each also preferably include a plurality of circumferential ribs located between the neck and the head of the spoke configured to aid in the detanglement of the clothing and linens. Also, the circumferential ribs are constructed preferably of a corrugated, flexible material such that the head of the spoke is able to flex in relation to the remainder of the spoke.

Dimensionally speaking, the spokes of the laundry aid device preferably are at least 1½ inches in diameter and the head of each of the spokes is 2 inches. Also, the plurality of the spokes preferably includes at least 8 spokes. The laundry aid device is placeable into a laundry machine to prevent tangling of clothing and linens and to further increase the efficiency of the laundering of the laundry machine; the laundry machine including both a clothes washer and clothes dryer.

According to another embodiment, a method of using the laundry aid device is also disclosed herein. The method of using a laundry aid device includes a first step, providing a laundry aid device, clothes washing machine and clothes dryer, and laundry; a second step, placing the clothing and the laundry within the clothes washing machine; a third step, adding laundry detergent to the clothes washing machine; a fourth step, placing the laundry aid device within the washing machine; a fifth step, commencing a washing cycle of the clothes washing machine; a sixth step, removing the laundry aid device and the laundry from the clothes washing machine; a seventh step, placing the laundry and laundry aid device into the clothes dryer; an eighth step, commencing operation of the clothes dryer; and a ninth step, ceasing operation of the clothes dryer.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a laundry aid device and method, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to textile laundering and more particularly to a laundry aid device and method as used to improve the efficiency of laundry machines and reduce instances of tangling of linens and clothing.

Generally, the laundry aid device keeps clothes and other linens separated in the clothes washer and dryer to optimize energy usage of such machines, cleansing and drying of such articles. The primary benefits of the laundry aid device is to maintain such articles from becoming entangled during the washing and drying processes, which would otherwise inhibit optimal washing and drying functions as the laundry aid device pushes and separates articles in laundry devices. The laundry aid device may be used in both the washing and drying cycles of laundering, eliminated the need for two separate devices such as dryer balls, etc.

Referring now more specifically to the drawings by numerals of reference, there is shown in FIGS. 1-4, various views of a laundry aid device 100.

Figure 1:
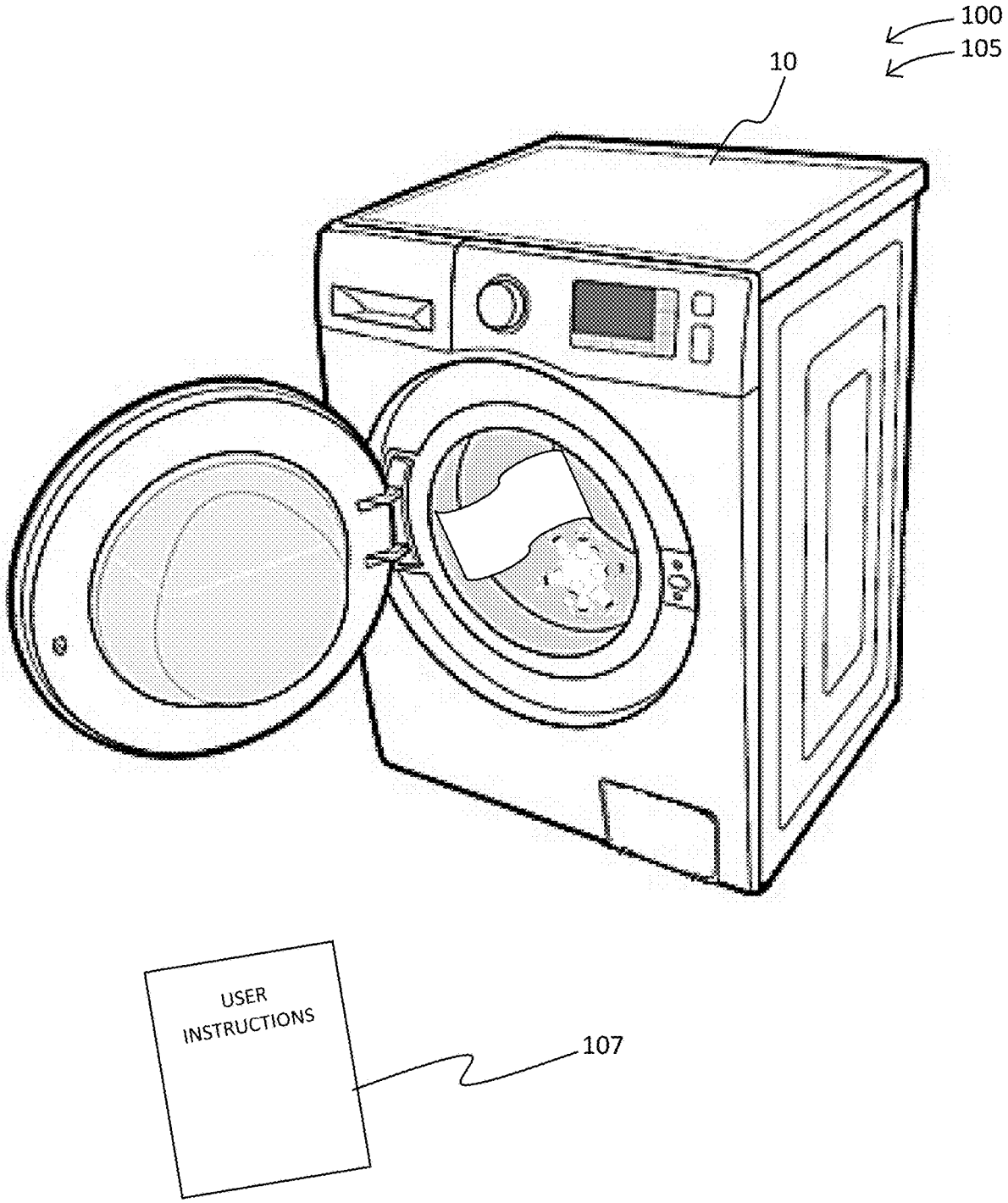
FIG. 1 is a perspective view of the laundry aid device during an 'in-use' condition, according to an embodiment of the disclosure.
Figure 2:
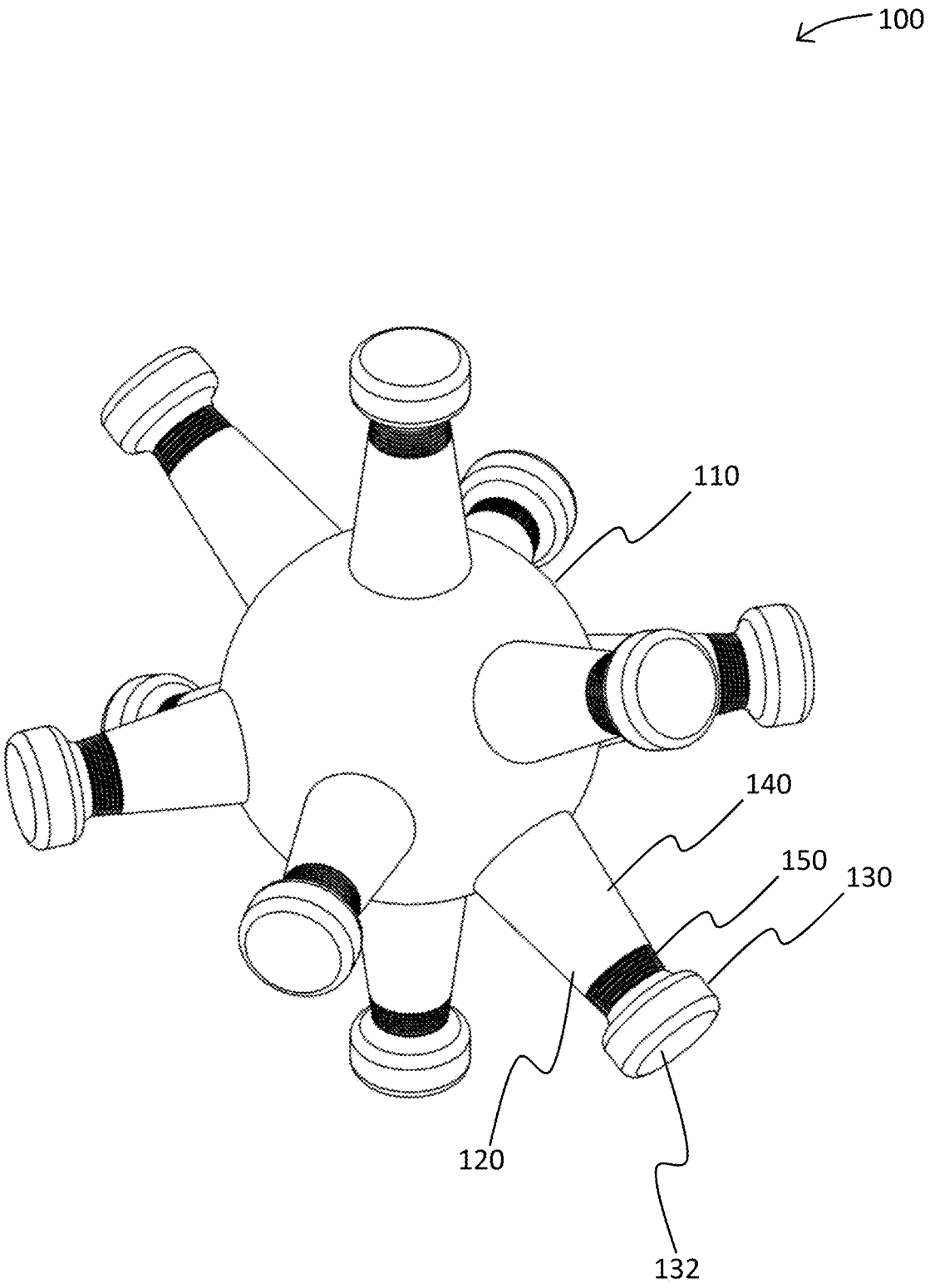
FIG. 2 is a perspective view of the laundry aid device of FIG. 1, according to an embodiment of the present disclosure.
Figure 3:
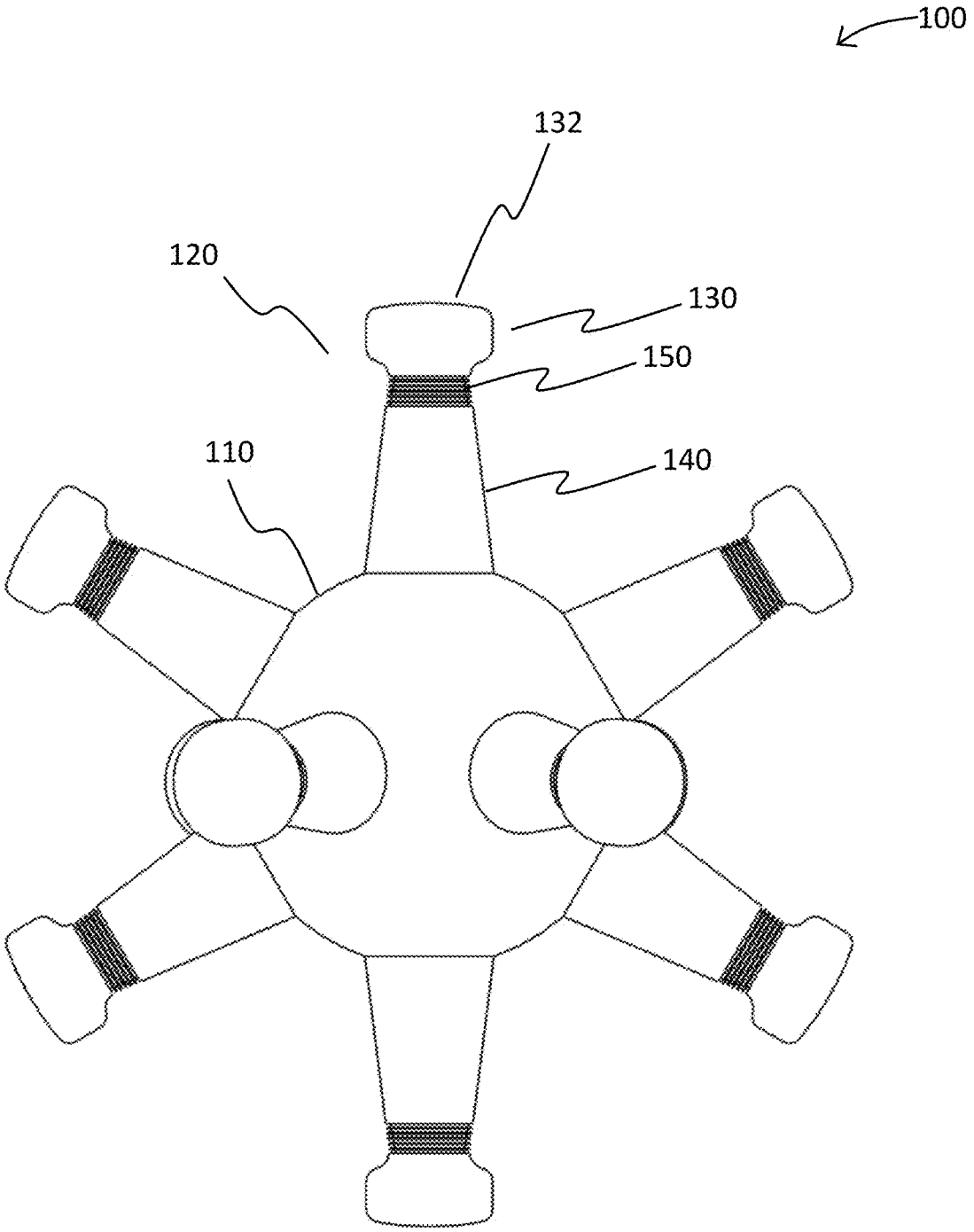
FIG. 3 is a front view of the laundry aid device of FIG. 2, according to an embodiment of the present disclosure.

FIG. 1 shows a laundry aid device 100 during an 'in-use' condition 50, according to an embodiment of the present disclosure. Here, laundry aid device 100 may be beneficial for use by a user to both increase the efficiency of laundry machines by maintaining a separation of articles and reduce instances of entanglement of laundered articles.

As illustrated in FIGS. 1-4, laundry aid device 100 may include spherical-body 110 and plurality of spokes 120. Each spoke 120 may extend radially from spherical-body 110, with each of spokes 120 including head 130 affixed to an end of spoke 120 furthest from spherical-body 110, and neck 140 disposed between spherical-body 110 and head 130.

Laundry aid device 100 may be placeable into laundry machine 10 to prevent tangling of clothing and linens and to further increase the efficiency of the laundering of laundry machine 10. Laundry machine 10 may include a clothes dryer in some embodiments. Alternate embodiments may include a clothes washing machine. Further embodiments may include a combination washer-dryer or other suitable laundering machine(s) 10.

Spherical-body 110 may be hollow (and/or semi-hollow and/or weighted) in some embodiments to reduce (overall) weight (of the laundry aid device 100) and provide a desired buoyancy of laundry aid device 100; where some embodiments may include spherical-body 110 constructed with a solid core to improve durability and increase the overall weight of laundry aid device 100.

Figure 4:
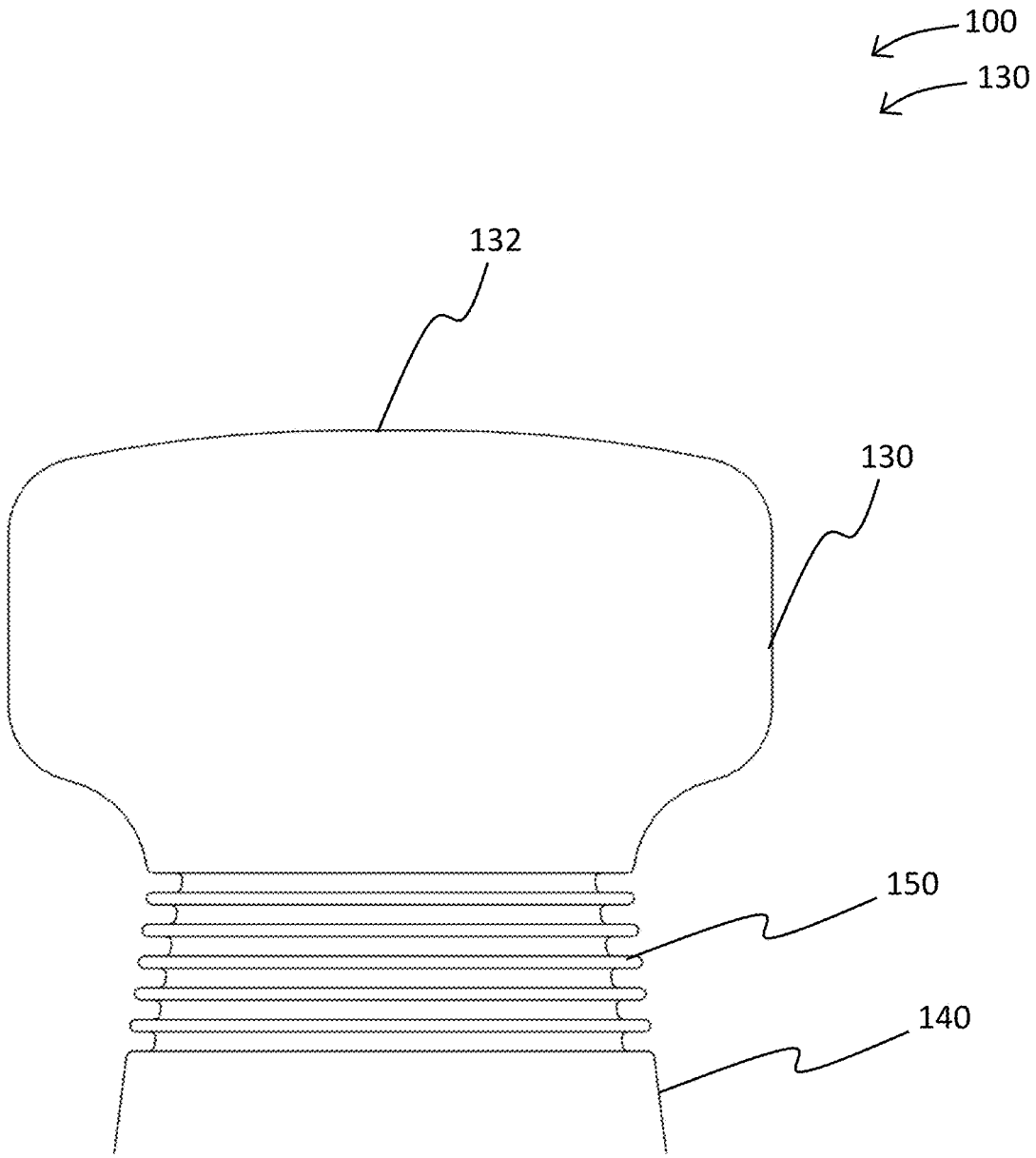
FIG. 4 is a detailed view of the laundry aid device of FIG. 2, according to an embodiment of the present disclosure.

Referring specifically now to FIG. 4, head 130 of each spoke 120 may include flat surface 132, with flat surface 132 arranged substantially parallel to surface of spherical body 110. Alternate embodiments may include alternate shapes. Also shown are spoke(s) 120, where each may further include a plurality of circumferential ribs 150 located between neck 140 and head 130 of spoke 120, configured to aid in the detanglement of the clothing and linens. As such, circumferential ribs 150 may be constructed of a corrugated, flexible material such that head 130 of each spoke 120 may be able to flex in relation to the remainder of spoke 120. Neck 140 of laundry aid device 100 may be constructed from a hollow material, in embodiments. Further embodiments may include neck 140 of laundry aid device 100 constructed from a solid material.

Spokes 120 of laundry aid device 100 may be at least 1½ inches in diameter, in some embodiments; however, alternate embodiments may employ alternate dimensions, sizes and/or shapes. Similarly, width of head 130 of each of spokes 120 may be at least 2 inches (or other suitable dimensions, depending upon specific preferences). Spokes 120 may include any shape and/or dimension (e.g., tubular, triangular, rectangular, etc.). Plurality of spokes 120 may include at least 8 spokes 120. Alternate embodiments may include more or less spokes 120.

Laundry aid device 100 may be constructed of a wide variety of materials depending upon user preferences and specific uses. As such, laundry aid device 100 may be constructed from a heat resistant rubber material. Also, laundry aid device 100 may be constructed from a heat resistant rubber material and/or an anti-fungal material. Laundry aid device 100 may be constructed from materials of differing colors, such that laundry aid device 100 may be more visible amount clothing and textiles (e.g., lime green, grape purple, lemon yellow, light blue, etc.) or other colors such as white, etc.

According to one embodiment, laundry aid device 100 may be arranged as kit 105. In particular, the laundry aid device 100 may further include a set of instructions 107. Instructions 107 may detail functional relationships in relation to the structure of laundry aid device 100 such that laundry aid device 100 can be used, maintained, or the like, in a preferred manner.

Figure 5:
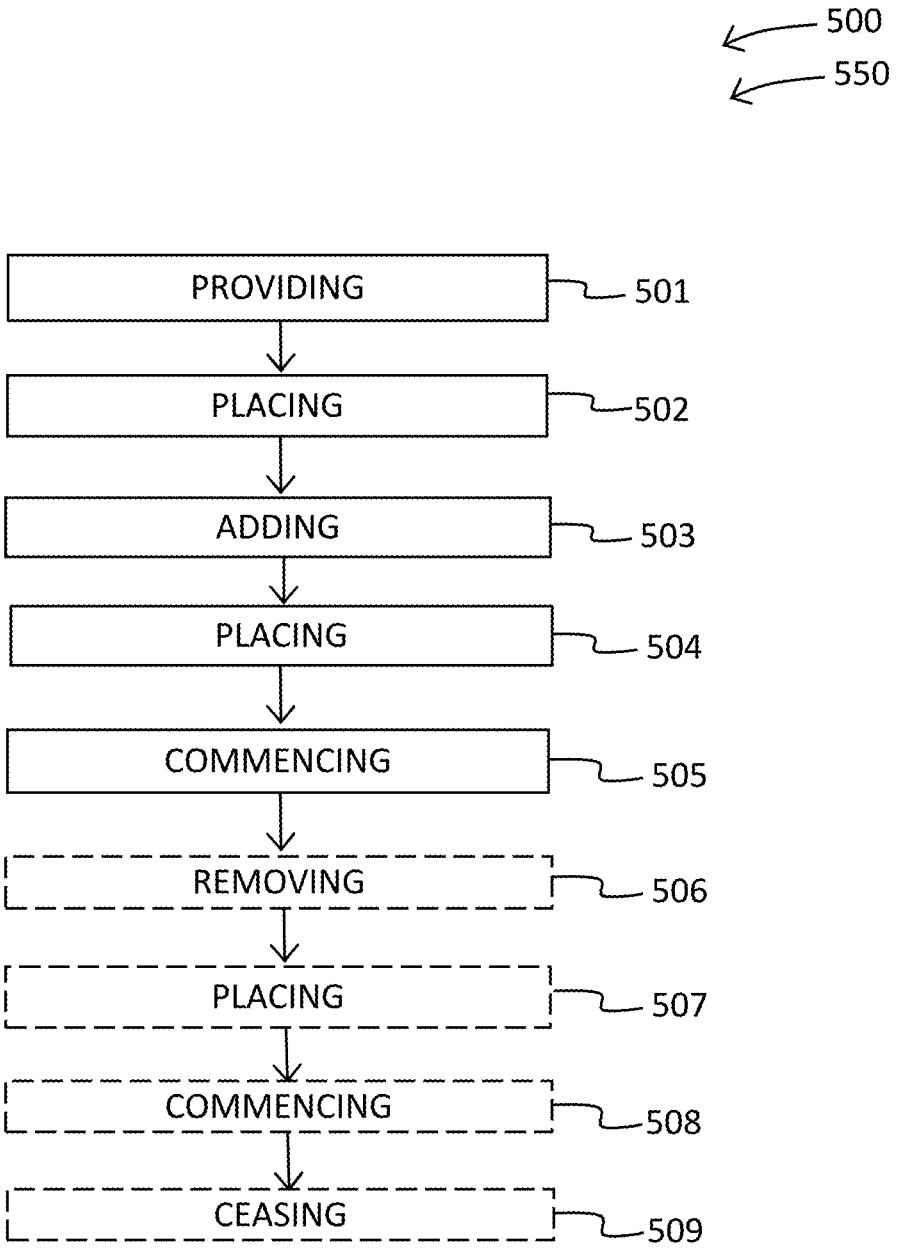
FIG. 5 is a flow diagram illustrating a method of use for the laundry aid device, according to an embodiment of the present disclosure.

FIG. 5 is a flow diagram illustrating method for using 500 a laundry aid device 100, according to an embodiment of the present disclosure. In particular, method of using 500 a laundry aid device 100 may include one or more components or features of laundry aid device 100 as described above. As illustrated, method of using 500 a laundry aid device 100 may include the steps of: step one 501, providing laundry aid device 100, clothes washing machine and clothes dryer, and laundry; step two 502, placing clothing and laundry aid device 100 within the clothes washing machine; step three 503, adding laundry detergent to the clothes washing machine; step four 504, placing laundry aid device 100 within the washing machine; step five 505, commencing a washing cycle of the clothes washing machine; step six 506, removing laundry aid device 100 and laundry from clothes washing machine; step seven 507, placing the laundry into a clothes dryer; step eight 508, commencing operation of the clothes dryer; and step nine 509, ceasing operation of the clothes dryer.

It should be noted that step six 506, step seven 507, step eight 508, and step nine 509 are optional steps and may not be implemented in all cases. Optional steps of method of use 500 are illustrated using dotted lines in FIG. 5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other 100

(NOTE: e.g., different step orders within above-mentioned list, elimination or addition of certain steps, including or excluding certain maintenance steps, etc.), are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A laundry aid device comprising:

a spherical-body;

a plurality of spokes each extending radially from said spherical-body, with each of said spokes including a head affixed to an end of said spoke furthest from said spherical-body, and a neck disposed between said spherical-body and said head wherein each of said spokes further include a plurality of circumferential ribs located between the neck and the head of the spoke configured to alleviate tangling of the clothing; and wherein said laundry aid device is placeable into a laundry machine to alleviate tangling of clothing and to further increase efficiency of laundering.

2. The device of claim 1, wherein said laundry machine is a clothes dryer.

3. The device of claim 1, wherein said laundry machine is a clothes washing machine.

4. The device of claim 1, wherein said spherical-body is hollow to decrease weight and provide a desired buoyancy of said laundry aid device.

5. The device of claim 1, wherein said spherical-body is solid to improve durability and increase an overall weight of said laundry aid device.

6. The device of claim 1, wherein said head of each of said spokes includes a flat surface, with said flat surface arranged substantially parallel to a plane tangent to the surface of said spherical-body.

7. The device of claim 1, wherein said circumferential ribs are constructed of a corrugated, flexible material such that the head of the spoke can flex in relation to the remainder of the spoke.

8. The device of claim 1, wherein said neck of said laundry aid device is constructed from a hollow material.

9. The device of claim 1, wherein said neck of said laundry aid device is constructed from a solid material.

10. The device of claim 1, wherein said spokes of said laundry aid device are at least 1½ inches in diameter.

11. The device of claim 1, wherein said spokes includes at least 8 said spokes.

12. The device of claim 1, wherein a width of said head of each of said spokes comprises 2 inches.

13. The device of claim 1, wherein said laundry aid device is constructed from a heat resistant rubber material.

14. The device of claim 1, wherein said laundry aid device is constructed from an anti-bacterial material.

15. The device of claim 1, wherein said laundry aid device is constructed from an anti-fungal material.

16. A laundry aid device comprising:

a spherical-body;

a plurality of spokes, said spokes extending tangentially from said spherical-body, with said each of said spokes including a head affixed to an end of said spoke furthest from said spherical-body, and a neck disposed between said spherical-body and said head;

wherein said laundry aid device is placeable into a laundry machine to prevent tangling of clothing and to further increase the efficiency of laundering of said laundry machine;

wherein said head of each of said spokes includes a flat surface, with said flat surface arranged substantially parallel to a plane tangent to the surface of said spherical-body;

wherein said spokes each further includes include a plurality of circumferential ribs located between the neck and the head of the spoke configured to alleviate tangling of the clothing;

wherein said circumferential ribs are constructed of a corrugated, flexible material such that the head of the can flex in relation to the remainder of said spoke;

wherein said spokes of said laundry aid device are at least 1½ inches in diameter;

wherein said spokes includes at least 8 said spokes;

wherein a width of said head of each of said spokes comprises 2 inches;

wherein said laundry aid device is constructed from a heat resistant rubber material;

wherein said laundry aid device is constructed from an anti-bacterial material;

and wherein said laundry aid device is constructed from an anti-fungal material.

17. The laundry aid device of claim 16, further comprising a set of instructions; and wherein said laundry aid device is arranged as a kit.

18. A method of using a laundry aid device comprising the steps of:

providing a laundry aid device comprising a spherical-body;

a plurality of spokes each extending radially from said spherical-body, with each of said spokes including a head affixed to an end of said spoke furthest from said spherical-body, and a neck disposed between said spherical-body and said head wherein each of said spokes further include a plurality of circumferential ribs located between the neck and the head of the spoke configured to alleviate tangling of the clothing wherein said laundry aid device is placeable into a laundry machine to alleviate tangling of clothing and to further increase efficiency of laundering providing a clothes washing machine, and a clothes dryer, and laundry;

placing the laundry within the clothes washing machine;

adding laundry detergent to aid the clothes washing machine;

placing the laundry aid device within the clothes washing machine; and commencing a washing cycle of the clothes washing machine.

19. The method of claim 18, further comprising the steps of:

removing said laundry aid device and said laundry from said clothes washing machine;

placing said laundry into a clothes dryer;

commencing operation of said clothes dryer;

and ceasing operation of said clothes dryer.

* * * * *